US010269268B2

(12) United States Patent
Debarros

(10) Patent No.: US 10,269,268 B2
(45) Date of Patent: Apr. 23, 2019

(54) FOLDING DISPLAY TOWER

(71) Applicant: Regency Display & Finishing, Inc., Clifton, NJ (US)

(72) Inventor: Jonathan Debarros, Harrison, NJ (US)

(73) Assignee: Regency Display & Finishing, Inc., Clifton, NJ (US)

( * ) Notice: Subject to any disclaimer, the term of this patent is extended or adjusted under 35 U.S.C. 154(b) by 337 days.

(21) Appl. No.: 14/790,319

(22) Filed: Jul. 2, 2015

(65) Prior Publication Data

US 2017/0004746 A1 Jan. 5, 2017

(51) Int. Cl.
*G09F 15/00* (2006.01)
*G09F 1/06* (2006.01)

(52) U.S. Cl.
CPC ..... *G09F 1/065* (2013.01); *G09F 15/0062* (2013.01)

(58) Field of Classification Search
None
See application file for complete search history.

(56) References Cited

U.S. PATENT DOCUMENTS

| | | | | |
|---|---|---|---|---|
| 2,283,406 | A * | 5/1942 | Bacon | A47F 5/114 211/133.1 |
| 6,347,772 | B1 | 2/2002 | L'Hotel | |
| 7,134,230 | B1 * | 11/2006 | Boens | G09F 1/06 40/124.07 |
| 8,826,833 | B1 * | 9/2014 | Fischer | A47B 43/02 108/162 |
| 2007/0245610 | A1 * | 10/2007 | Mestres Armengol | A47F 5/10 40/610 |
| 2012/0012734 | A1 * | 1/2012 | Tzuo | G09F 1/06 248/683 |
| 2013/0219760 | A1 * | 8/2013 | Acker | G09F 1/06 40/610 |

* cited by examiner

*Primary Examiner* — Kristina N Junge
(74) *Attorney, Agent, or Firm* — Wood Herron & Evans LLP

(57) ABSTRACT

A display unit for conveying information to a desired audience includes an outer shell having one or more areas for displaying information, and an inner support assembly coupled to the outer shell and configured to support the outer shell during use of the display unit. The display unit has at least one folded position and a use position, wherein the display unit is self-deployable such that the display unity automatically transitions from a folded position to the use position. In accordance with an aspect of the invention, the display unit may automatically transition from a folded position to the use position under a force generated from the display unit itself. A method of using the display unit is also disclosed.

18 Claims, 11 Drawing Sheets

FOLDING DISPLAY TOWER

TECHNICAL FIELD

The present invention relates generally to display units intended to provide visual information, and more particularly to a display unit that is compact and includes a self-deployable aspect.

BACKGROUND

Display units are frequently used by businesses and other organizations to provide visual information such as, for example, advertising information or other types of information at a point of sale, trade show, or public venue. The visual information may include any combination of words, colors, and images, as may be desired, so that the display unit may effectively communicate the information to a desired audience. When not in use, a display unit may be stored or transported to a location where it is to be used. For example, some display units may be disassembled and/or at least partially collapsed into a folded position for storing and transportation, and may be subsequently assembled and/or erected into a use position for providing the visual information.

Generally, display units consist of a front face carrying visual information, and are intended to be placed on the ground, a tabletop, or other surface. This front face can be held in a vertical position by means of a support structure, such as, for example, a stand-type device. This type of device may include a tripod, a poster display stand, a banner stand, and the like. Other display units may consist of multiple front faces, each carrying visual information, held in a vertical position by a similar device, in order to display visual information to observers on different sides of the display unit. However, display units such as these are relatively bulky and cannot be transported easily, and require difficult manipulations in order to be arranged into a use position or to be arranged into a folded position.

Therefore, a need exists for a display unit which is easily movable between a folded position and a use position, and which is compact and easily storable in the folded position.

SUMMARY

A display unit for conveying information to a desired audience includes an outer shell having one or more areas for displaying information, and an inner support assembly coupled to the outer shell and configured to support the outer shell during use of the display unit. The display unit has at least one folded position and a use position, wherein the display unit is self-deployable such that the display unit automatically transitions from a folded position to the use position. In accordance with an aspect of the invention, the display unit may automatically transition from a folded position to the use position under a force generated from the display unit itself.

In one embodiment, the support assembly includes an upper support panel and a lower support panel coupled together by at least one spring member configured to exert a tension force on the upper and lower support panels when the display unit is in a folded position. The upper and lower support panels are foldable between an expanded position and a collapsed position and are configured to fold about a panel fold line. In the at least one folded position, the support assembly is folded within the outer shell such that the upper and lower support panels are collapsed along the respective panel fold lines. The at least one folded position may include an intermediate position, wherein the at least one spring member exerts a tension force on the upper and lower support panels such that the upper and lower support panels are biased toward each other along their respective panel fold line when in the intermediate position. In this way, the biasing of the upper and lower support panels along their respective panel fold lines causes the upper and lower support panels to expand such that the display unit transitions to the use position.

In an exemplary embodiment, the upper and lower support panels have an elliptical configuration that provides a plurality of sides to the display unit for viewing the information provided thereon. The upper and lower support panels may be fixedly attached to an interior wall of the outer shell. In one embodiment, the upper and lower support panels each include a hinge flap, wherein the at least one spring member is coupled to each hinge flap. Moreover, in one embodiment, the upper and lower support panels are coupled together by two spring members and a spacer disposed therebetween. The at least one spring member may include an elastic band.

In one embodiment, the support assembly may further include a central support panel disposed between the upper and lower support panels, the central support panel having an opening, and the at least one spring member may extend through the opening. The central support panel may also include a fold line. In one embodiment, the central support panel may be at least partially folded about the fold line when the display unit is in the use position.

In another embodiment, the display unit may further include at least one air release hole positioned on at least one of the outer shell and the inner support assembly.

A method of erecting a display unit having an outer shell with lateral fold lines and an inner support assembly for supporting the outer shell, the display unit having a folded, an intermediate, and a use position, includes gripping a portion of the display unit in the folded position, and releasing the display unit such that the display unit self-deploys from the folded position to the use position. The method may include transitioning the display unit from the folded position to the intermediate position by allowing the remaining portions of the display unit to unfold about the lateral fold lines under the influence of gravity. The method may further include transitioning the display unit from the intermediate position to the use position using a force generated by the display unit itself.

In one embodiment, transitioning the display unit from the intermediate position to the use position further includes expanding the inner support assembly using a force generated by the display unit itself. More particularly, the inner support assembly includes upper and lower support panels coupled together by at least one spring member, wherein the at least one spring member exerts a tension force on the upper and lower support panes in the intermediate position to generate the force for transitioning the display unit to the use position.

DETAILED DESCRIPTION

Figure 1:
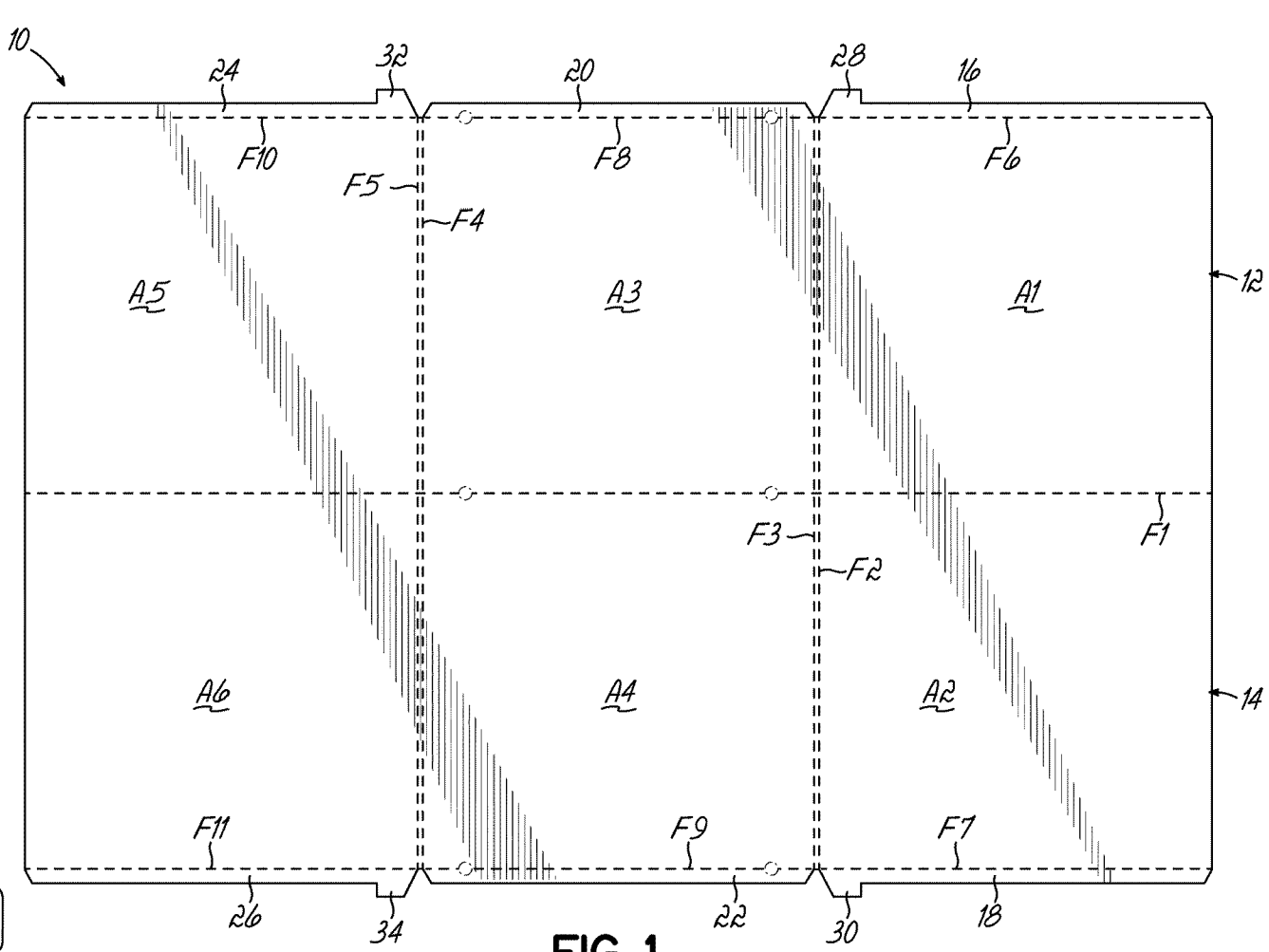
FIG. 1 is a top view of an exemplary sheet for forming a display unit in accordance with the principles of the present invention.

Referring now to FIGS. 1-5, various components for forming a display unit in accordance with the principles of the present invention are provided. With specific reference to FIG. 1, an exemplary sheet 10 for forming a display unit is shown. The sheet 10 may be constructed of any suitable material, such as, for example, paperboard, card stock, and the like. The sheet 10 includes a longitudinal fold line F1 positioned along a longitudinal centerline of the sheet, which divides the sheet into first and second front faces 12, 14, and lateral fold lines F2, F3, F4, F5, which, together with the longitudinal fold line F1, divide the sheet into a plurality of poster areas for carrying the desired visual information. For example, in the embodiment shown, the sheet is divided into six poster areas, including two upper poster areas A1, A2, two central poster areas A3, A4, and two lower poster areas A5, A6. However, it should be appreciated that any number of lateral fold lines may be used to divide the sheet into any number of poster areas, as may be desired. For example, additional lateral lines may be included in applications where the desired display unit is relatively tall.

Flaps 16, 18, 20, 22, 24, 26 are provided along the longitudinal periphery of each of the poster areas A1, A2, A3, A4, A5, A6 and are separated from their respective poster areas by way of flap fold lines F6, F7, F8, F9, F10, F11. The flaps 16, 18, 24, 26 associated with the upper and lower poster areas A1, A2, A5, A6 include upper and lower flap tabs 28, 30, 32, 34, which may be positioned proximate the flaps 20, 22 associated with the central poster areas A3, A4, as shown.

Figure 4:
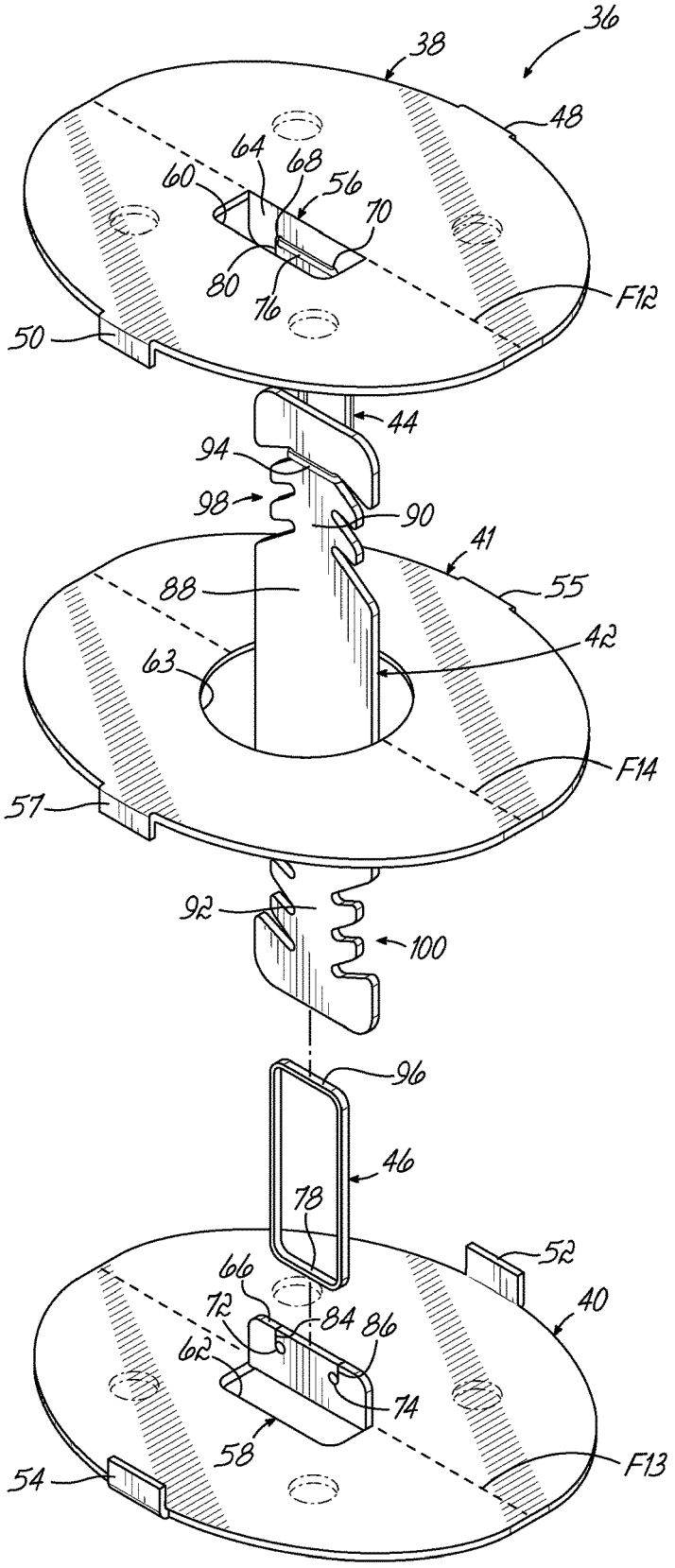
FIG. 4 is a perspective view of a support assembly for forming a display unit in accordance with the principles of the present invention.

With specific reference now to FIG. 4, a support assembly 36 for forming a display unit in accordance with the principles of the present invention includes upper and lower support panels 38, 40 (FIG. 2) coupled to a central spacer or bracket 42 (FIG. 3) by way of spring members such as, for example, elastic bands 44, 46, capable of storing energy when stretched such that a tension force may be applied to the support panels. The upper and lower support panels 38, 40 may be constructed of a material stronger than that of the sheet 10, such as, for example, cardboard, or any other suitable material, and each comprises a shape generally corresponding to the cross-sectional shape of the desired display unit. For example, the upper and lower support panels 38, 40 may each comprise a generally elliptical shape, as shown.

The upper and lower support panels 38, 40 each include a panel fold line F12, F13 along an axis of the support panel. The upper and lower support panels 38, 40 also each include first and second oppositely disposed panel tabs 48, 50, 52, 54 positioned on an outer periphery of the support panel and which extend in a direction substantially parallel to the fold line F12, F13. As shown, the fold lines F12, F13 may extend along the major axes of the support panels 38, 40 and the panel tabs 48, 50, 52, 54 may be tangential to the minor axes of the support panels, respectively. Each panel tab 48, 50, 52, 54 is folded perpendicular to the plane of the support panel 38, 40, such as, for example, in a direction toward the other support panel 38, 40.

Figure 2A:
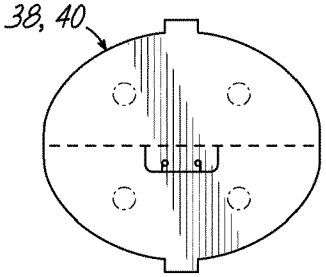
FIG. 2A is a top view of an exemplary upper or lower support panel for forming a display unit in accordance with the principles of the present invention.
Figure 2B:
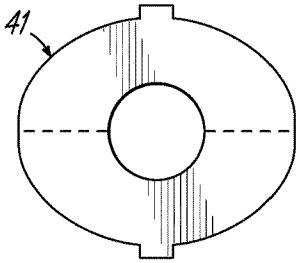
FIG. 2B is a top view of an exemplary central support panel for forming a display unit in accordance with the principles of the present invention.

A central portion 56, 58 of each support panel 38, 40 is cutout and folded along the fold line F12, F13 to provide an aperture 60, 62 and a hinge flap 64, 66 oriented in a direction toward the other support panel 38, 40. Each hinge flap 64, 66 includes a pair of holes 68, 70, 72, 74 for retaining a leg 76, 78 of an associated elastic band 44, 46. In the embodiment shown, slots 80, 82, 84, 86 are provided in the hinge flaps 64, 66 adjacent the holes 68, 70, 72, 74 for maneuvering portions of the elastic bands 44, 46 into the holes. As shown in FIG. 2, a single blank may be used to construct either the upper or lower support panel 38, 40.

The elastic bands 44, 46 couple the upper and lower support panels 38, 40 to the central bracket 42 (FIG. 3), which may be constructed of a durable material, such as, for example, a flexible plastic, such that it can withstand the tension force of the elastic bands. The central bracket 42 includes an elongate portion 88 and upper and lower coupling portions 90, 92, which are each configured for receiving a leg 94, 96 of an associated elastic band 44, 46. As shown, each coupling portion 90, 92 may include a series 98, 100 of fingers and grooves, such that a leg 94, 96 of an elastic band 44, 46 may be positioned within a selected groove and retained therein by adjacent fingers. A particular groove may be selected based on various factors, such as the desired tension force and the display unit height. In this manner, the central bracket 42 may act as a spacer for a variety of applications and provide adjustability to the support assembly 36. Alternatively, the upper and lower support panels 38, 40 may be directly coupled by, for example, a single elastic band, such that the central bracket may be eliminated (not shown).

In one embodiment, the support assembly 36 may further include a central support panel 41 (FIG. 2B), which may have a configuration substantially similar to that of the upper and lower support panels 38, 40. For example, the central support panel 41 may comprise a generally elliptical shape and may include a panel fold line F14, as well as first and second oppositely disposed panel tabs 55, 57. As shown, a clearance hole 63 may be provided through a central portion of the central support panel 41 to allow the central bracket 42 and/or the elastic bands 44, 46 to pass therethrough.

Figure 5:
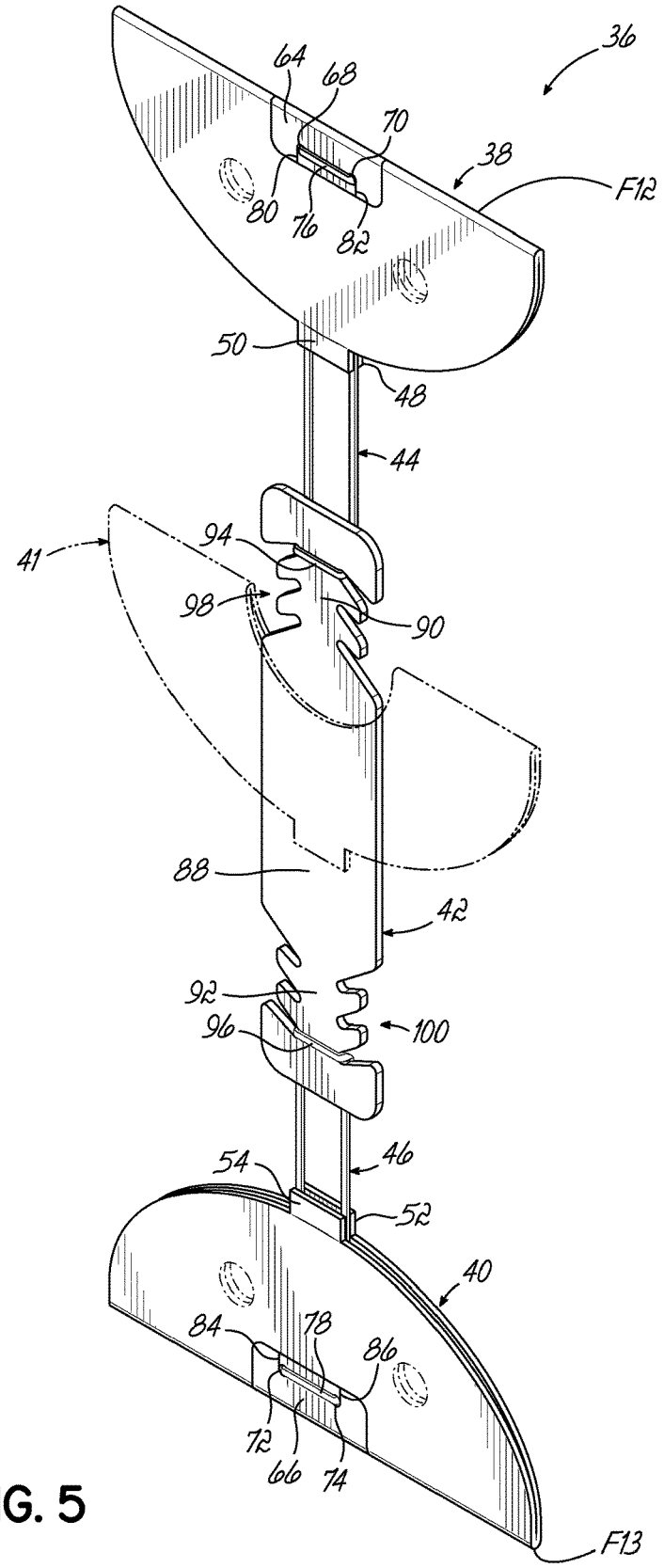
FIG. 5 is a perspective view of the support assembly of FIG. 4 showing the support panels in collapsed positions.

The upper and lower support panels 38, 40 are movable between an expanded position, as shown in FIG. 4, and a collapsed position, wherein the support panels are collapsed along their respective fold lines F12, F13, as shown in FIG. 5. By maintaining the panel tabs 48, 50 of the upper support panel 38 at a fixed vertical distance from the panel tabs 52, 54 of the lower support panel 40 (for reasons described more fully below), the collapsing of the upper and lower support panels causes the hinge flaps 64, 66 at the central portions 56, 58 of the panels 38, 40 to move away from each other such that the elastic bands 44, 46 stretch, creating tension therein. The elastic bands 44, 46, in turn, exert a tension force on the hinge flaps 64, 66 of the upper and lower support panels 38, 40, thereby biasing the hinge flaps toward each other, as will be described below.

Figures 6, 6A:
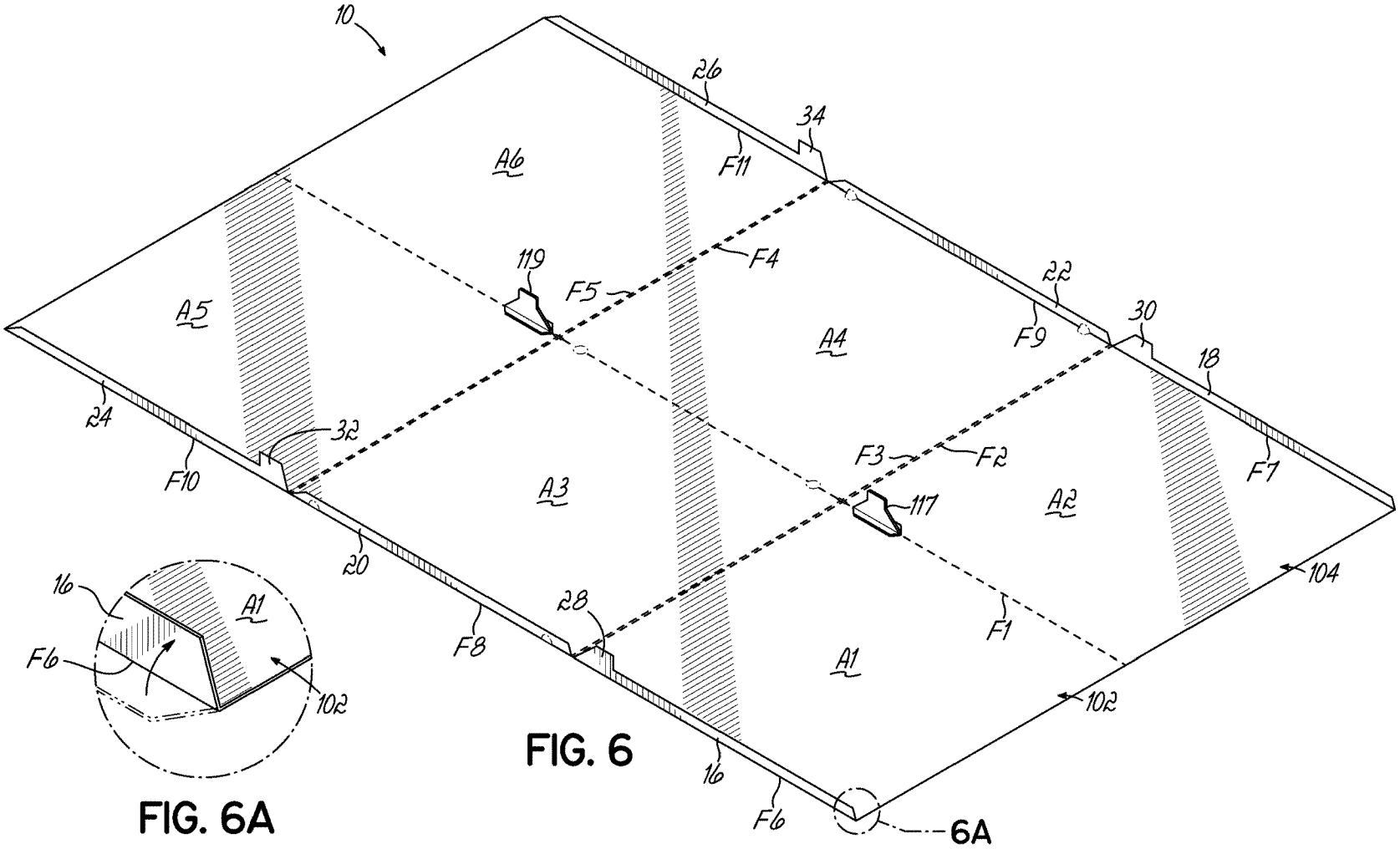
FIG. 6 is a perspective view of the sheet of FIG. 1 showing the flaps folded along their respective fold lines.
FIG. 6A is a close-up view of a corner of the sheet of FIG. 6.
Figure 7:
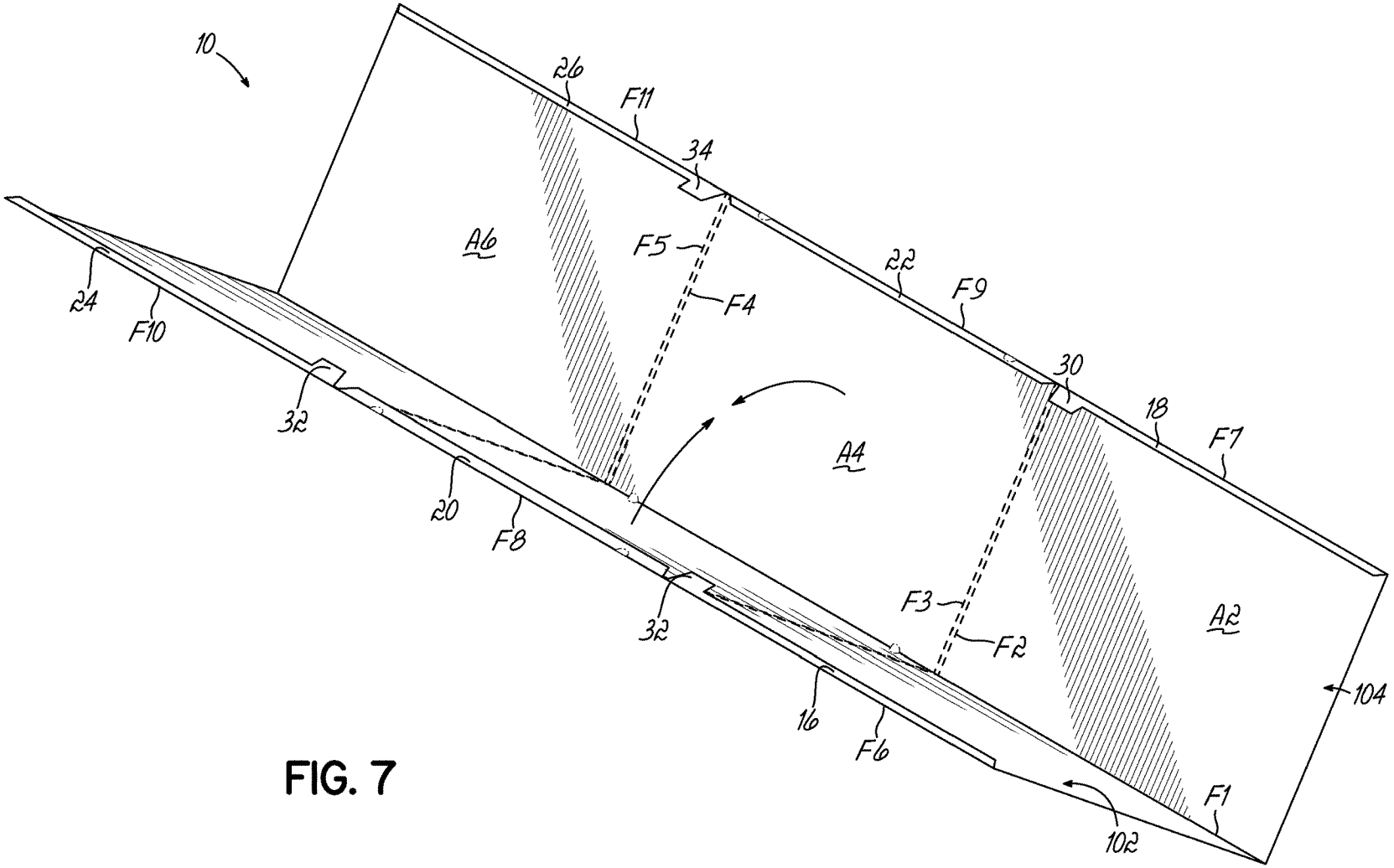
FIG. 7 is a perspective view of the sheet of FIG. 1 as it is being folded along a longitudinal fold line.
Figure 8:
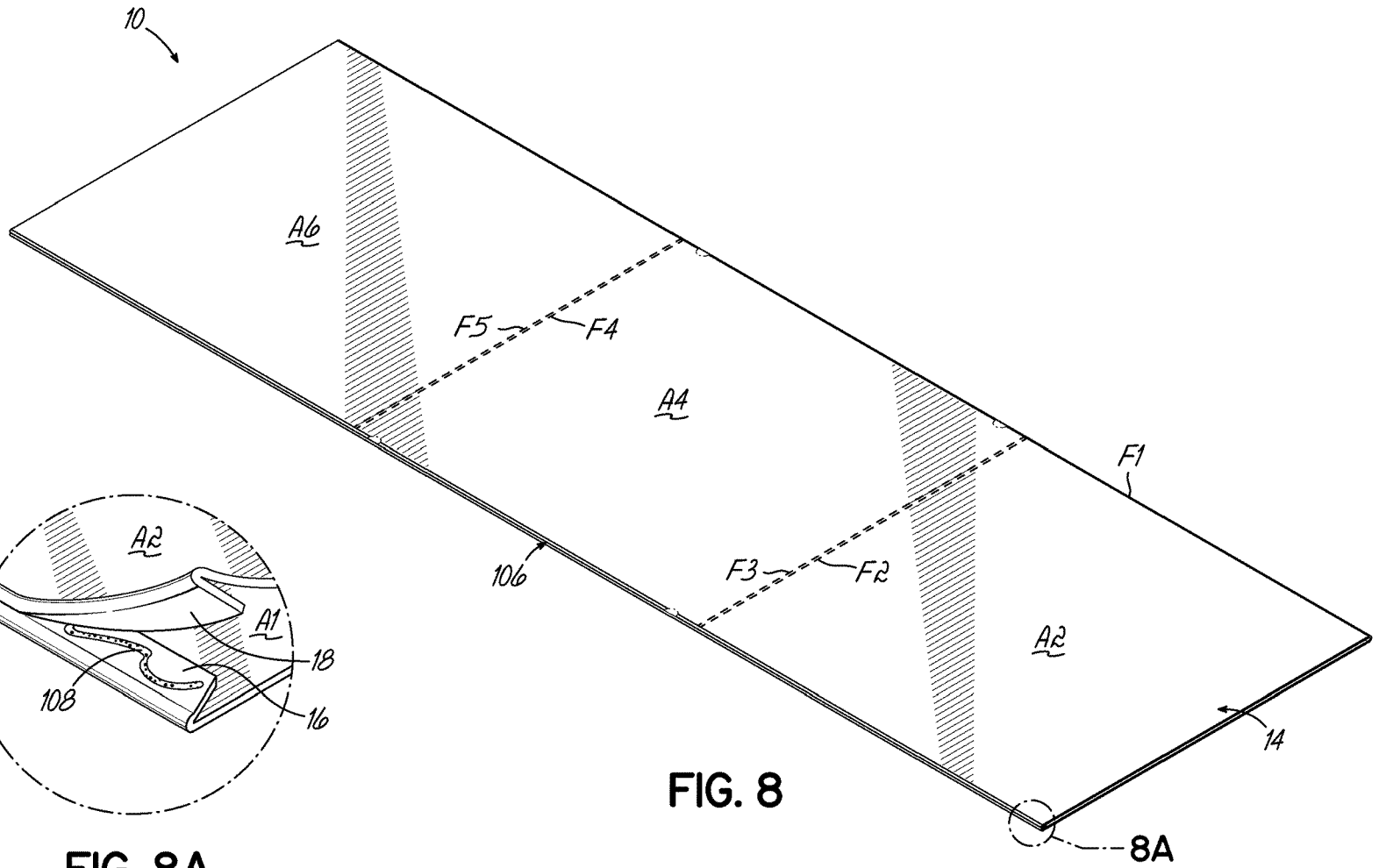
FIG. 8 is a perspective view of the sheet of FIG. 1 in a folded position.
Figure 8A:
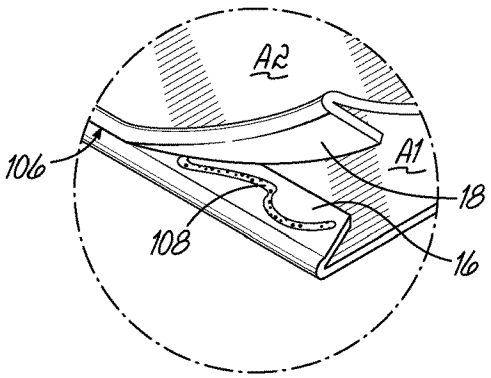
FIG. 8A is a close-up view of a corner of the sheet of FIG. 8.

Referring now to FIGS. 6-8A, in one embodiment, in order to assemble a display unit in accordance with the principles of the present invention, the flaps 16, 18, 20, 22, 24, 26 of the sheet 10 are folded along respective flap fold lines F6, F7, F8, F9, F10, F11 in a direction away from the first and second front faces 12, 14, i.e., in a direction toward corresponding first and second rear faces 102, 104 of the sheet, as indicated by the arrow in FIG. 6A. The first and second rear faces 102, 104 may then be folded toward each other along the longitudinal fold line F1, as indicated by the arrows in FIG. 7, until the sheet 10 has been folded over itself along the longitudinal fold line F1, as shown in FIG. 8. In this position, the folded flaps 16, 20, 24 of the first front face 12 may be attached to the adjacent folded flaps 18, 22, 26 of the second front face 14 to form a seam 106. Likewise, the upper and lower flap tabs 28, 30, 32, 34 may be attached to form respective upper and lower seam tabs. As shown in FIG. 8A, the folded flaps 16, 18, 20, 22, 24, 26 may be attached by an adhesive 108 or any other suitable fastener, such as, for example, staples, clips, tape, ties, and the like.

Figure 9:
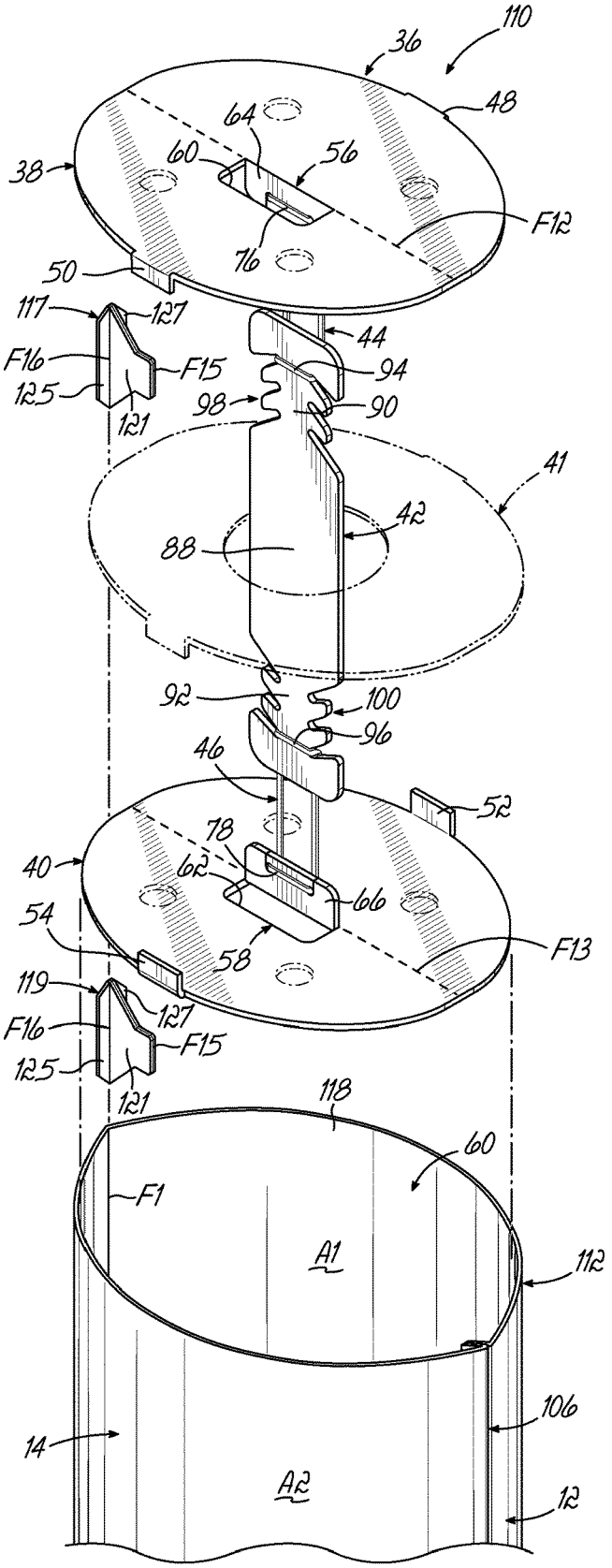
FIG. 9 is an exploded view of an exemplary display unit in accordance with the principles of the present invention.
Figure 10:
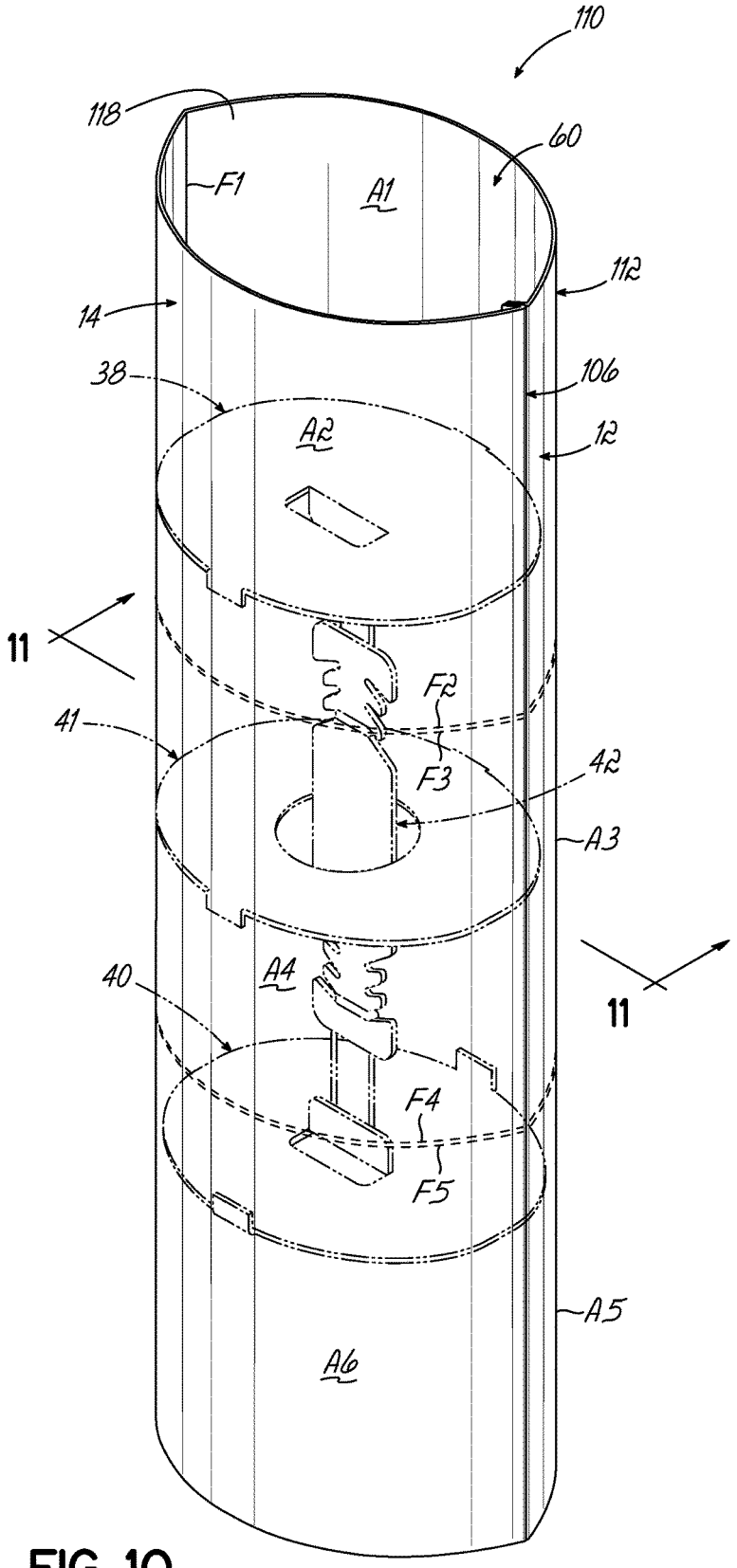
FIG. 10 is a perspective view of the display unit of FIG. 9.
Figure 11:
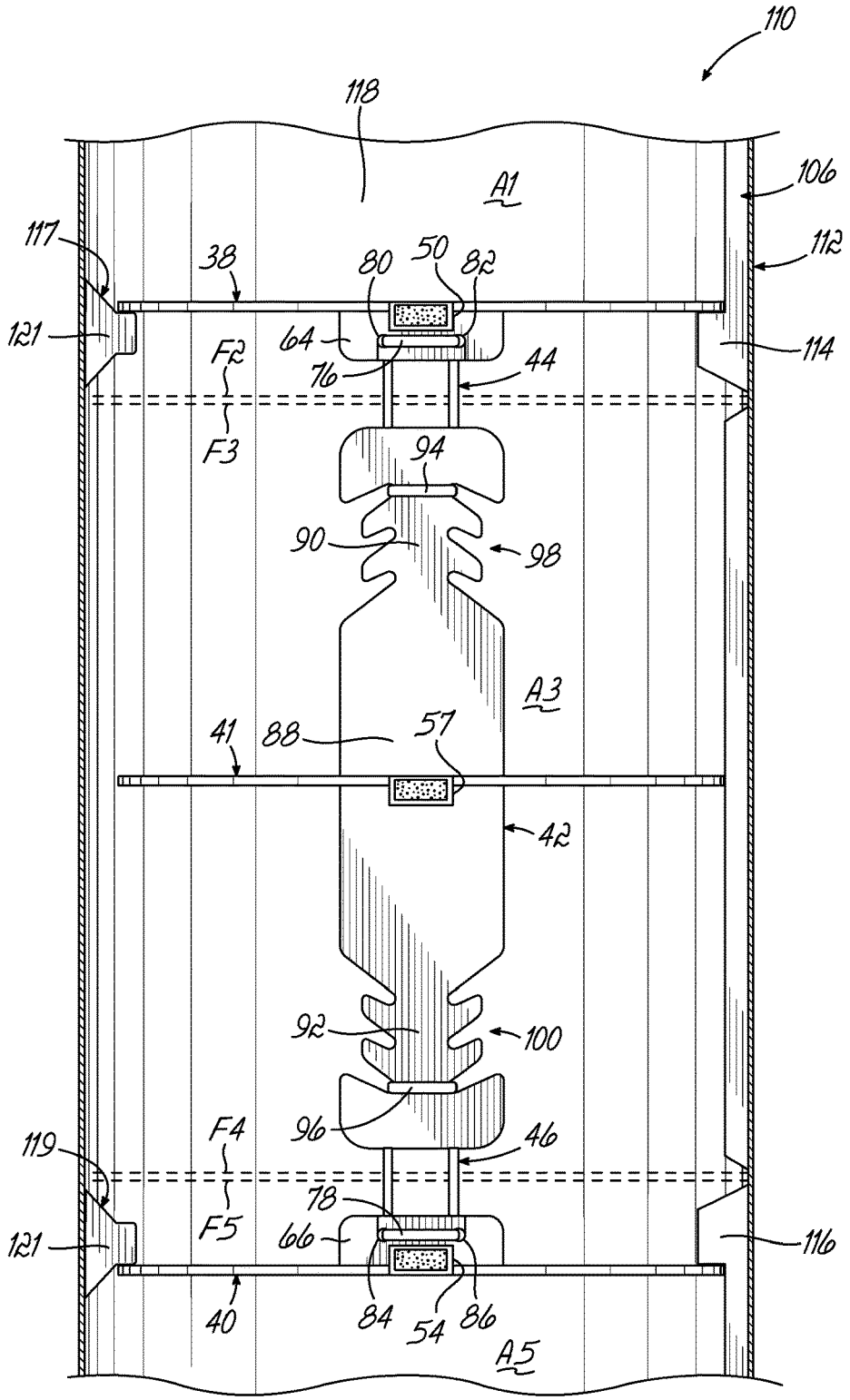
FIG. 11 is a cross sectional view of the display unit of FIG. 10, taken along line 11-11.

Turning now to FIGS. 9-11, an exemplary display unit 110 is assembled by expanding the folded sheet 10 into a shell 112 having a generally elliptical cross section and inserting the support assembly 36 therein. The sheet 10 may be expanded into such a shell 112 by, for example, applying pressure to the seam 106 and longitudinal fold line F1 of the folded sheet such that the first and second front faces 12, 14 are forced away from each other to each assume a generally convex configuration, as best shown in FIG. 10. In order to prevent the seam 106 from interfering with the positioning of the support assembly 36, the upper and lower support panels 38, 40 may be truncated at or near the ends of their respective major axes.

The support assembly 36 is positioned within the shell 112 such that the upper support panel 38 engages the upper seam tab 114, made up of the upper flap tabs 28, 30, and the lower support panel engages the lower seam tab 116, made up of the lower flap tabs 32, 34. In this manner, the upper and lower seam tabs 114, 116 provide a positive stop for the upper and lower support panels 38, 40, respectively. As such, the upper support panel 38 is positioned between the upper poster areas A1, A2, the lower support panel 40 is positioned between the lower poster areas A5, A6, and the central bracket 42 is positioned between the central poster areas A3, A4.

Figure 2C:
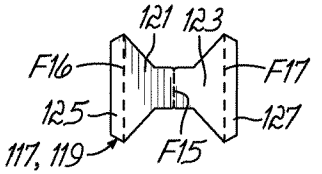
FIG. 2C is a top view of an exemplary auxiliary tab for forming a display unit in accordance with the principles of the present invention.
Figure 3:
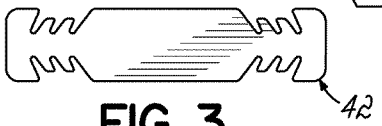
FIG. 3 is a top view of an exemplary central bracket for forming a display unit in accordance with the principles of the present invention.

In some applications, it may be desirable to provide an additional positive stop opposite the upper and lower seam tabs 114, 116. Accordingly, in one embodiment, upper and lower auxiliary tabs 117, 119 may be provided along the longitudinal fold line F1 at heights generally corresponding to those of the upper and lower seam tabs 114, 116. As shown in FIG. 2C, the auxiliary tabs 117, 119 may each include first and second tab portions 121, 123 separated by a tab fold line F15 and first and second base portions 125, 127 adjacent the first and second tab portions, respectively, and separated therefrom by base fold lines F16, F17, respectively. The auxiliary tabs 117, 119 may each be folded over themselves along the tab fold line F15, and the base portions 125, 127 may be attached to the interior wall 118 of the shell 112 along, and on opposite sides of, the longitudinal fold line F1, as shown in FIG. 9. The base portions 125, 127 may be attached to the interior wall 118 by an adhesive or any other suitable fastener, such as, for example, staples, clips, tape, ties, and the like. In one embodiment, the auxiliary tabs 117, 119 may be attached to the sheet 10 along the longitudinal fold line F1 prior to the folding of the sheet, as shown in FIG. 6.

As shown in FIG. 11, the central bracket 42 may be sized such that it does not extend beyond the lateral fold lines F3, F4, so that the central bracket may not interfere with the folding or unfolding of the display unit 110. In addition, the panel tabs 48, 50, 52, 54 are each attached to the interior wall 118 of the shell 112 to retain the support assembly 36 therein, such that the display unit 110 is an integral unit, and to maintain the panel tabs 48, 50 of the upper support panel 38 at a fixed vertical distance from the panel tabs 52, 54 of the lower support panel 40 in both the expanded and collapsed positions.

Figure 12:
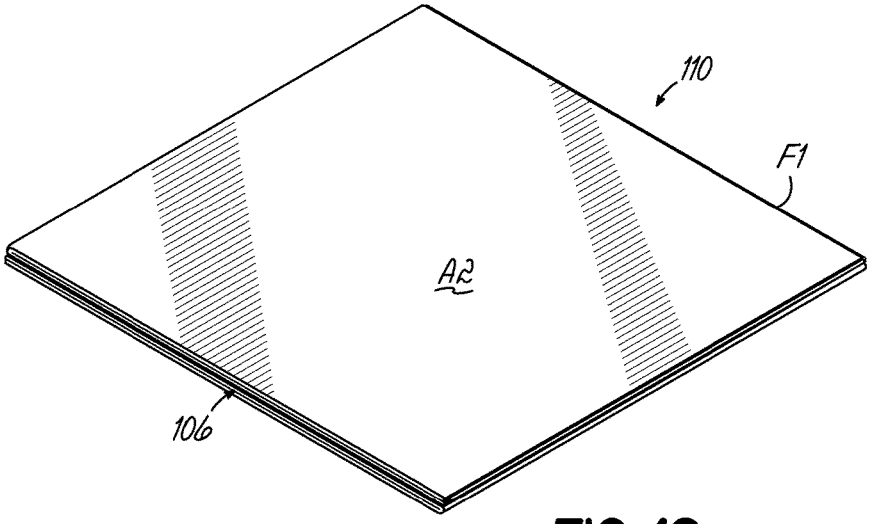
FIG. 12 is a perspective view of the display unit of FIG. 10 in a folded position.

A method of erecting a display unit in accordance with the principles of the present invention will now be described. For description purposes, the display unit 110 is initially assumed to be in a folded position, as shown in FIG. 12. In this position, support assembly 36 is folded within the shell 112, so that the display unit 110 remains integral. Specifically, the upper and lower support panels 38, 40 are collapsed (FIG. 5) and reside between the upper and lower poster areas A1, A2, A5, A6, respectively, and the central bracket 42 resides between the central poster areas A3, A4. Accordingly, the folded display unit 110 is relatively flat and compact, such that it may be easily stored and/or transported. In one embodiment, the folded display unit 110 may be less than or equal to approximately 24"×24"×2". Other dimensions, however, may also be possible. Advantageously, the folded display unit 110 may be transported via postal service.

Figure 13:
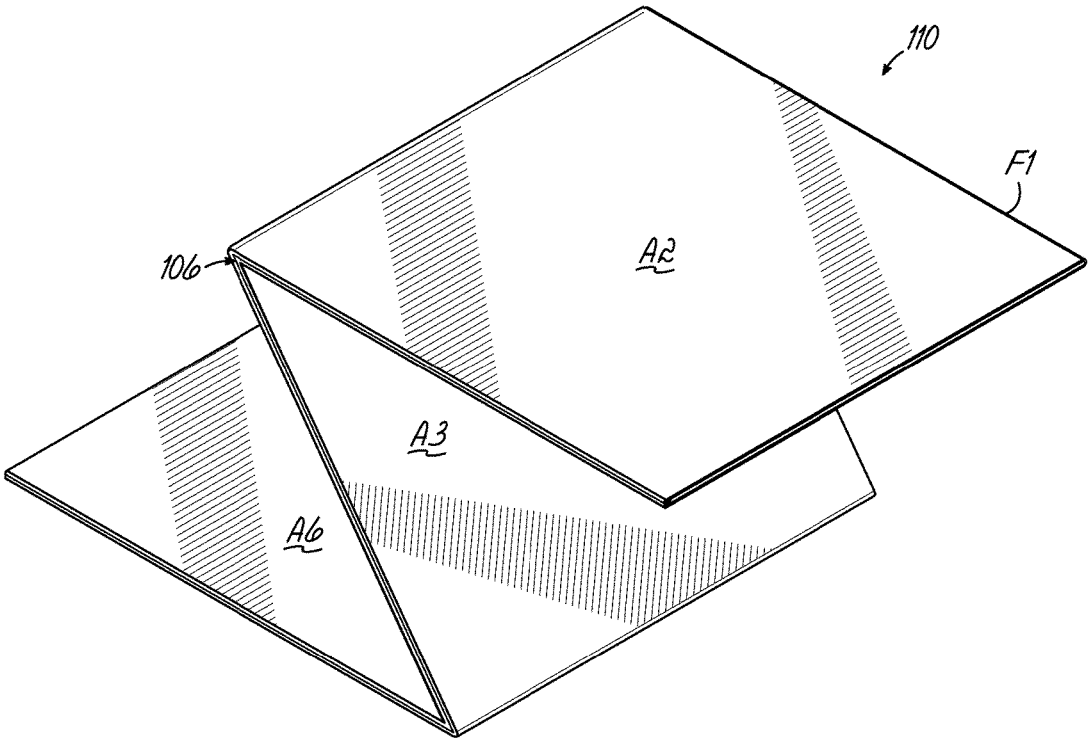
FIG. 13 is a perspective view of the display unit of FIG. 12 as it is being unfolded along lateral fold lines.

When the display unit 110 is to be used, for example when an end user has received it by postal service, the process of erecting the display unit is carried out in a simple, straightforward manner. To this end, it suffices to grip one or both of the upper poster areas A1, A2 along the seam 106 and longitudinal fold line F1 and hold it above the rest of the display unit 110. By then releasing the rest of the display unit, the display unit 110 is unfolded about the lateral fold lines F2, F3, F4, F5 under gravity, as shown in FIG. 13.

Figure 14:
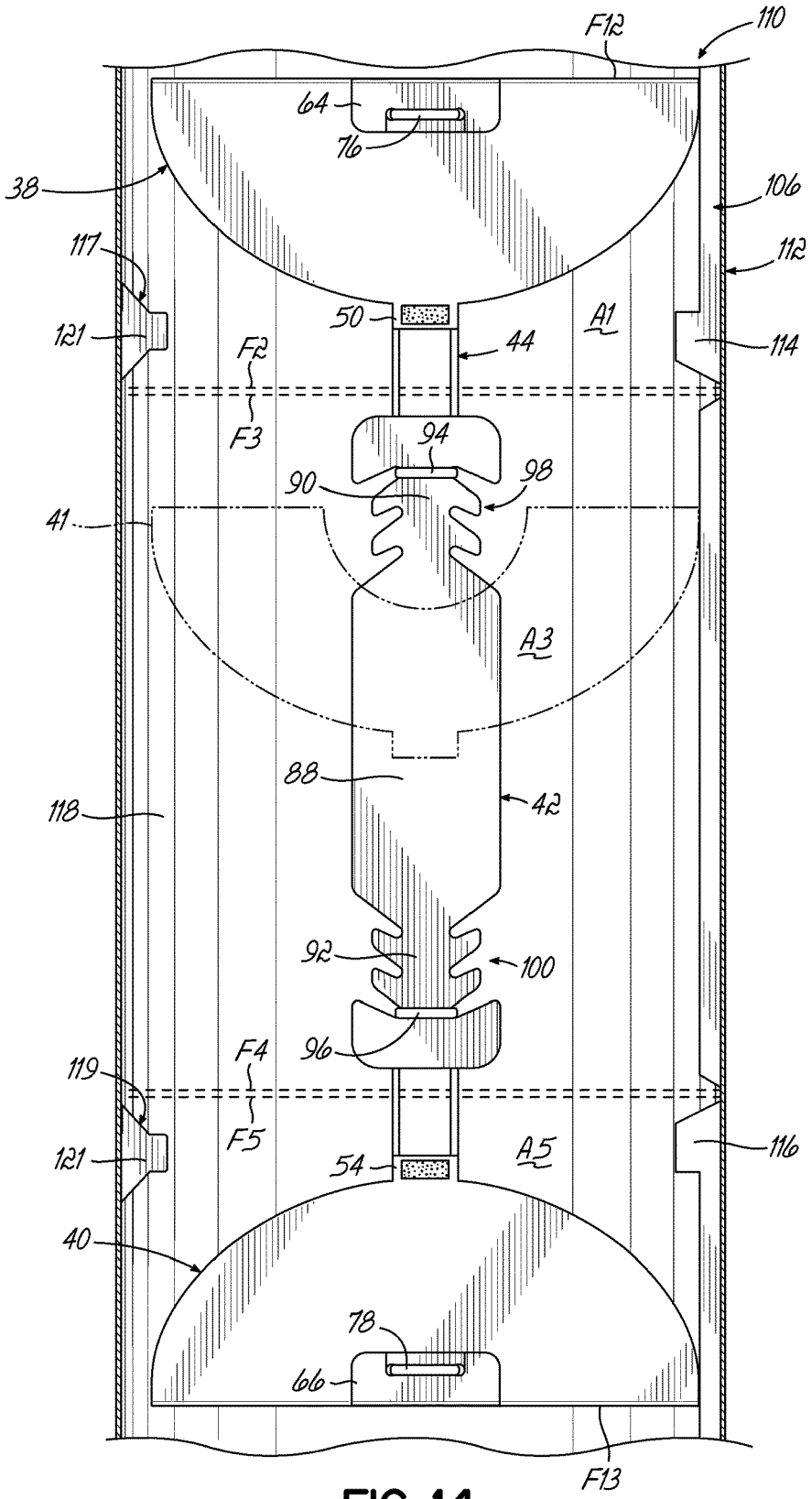
FIG. 14 is a cross sectional view similar to FIG. 11, showing the support panels in collapsed positions and the spring members in tension.

Once the display unit 110 has been fully unfolded about the lateral fold lines F2, F3, F4, F5, the display unit is momentarily in an intermediate position, as shown in FIG. 14. In the intermediate position, the collapsed support panels 38, 40 place the elastic bands 44, 46 in tension by virtue of the distance between their respective hinge flaps 64, 66. Therefore, the elastic bands 44, 46 exert a tension force on the hinge flaps 64, 66, biasing the hinge flaps toward each other, with the central bracket 42 acting as a central pull mechanism. Since the panel tabs 48, 50, 52, 54 are attached to the interior wall 118 of the display unit 110 at fixed locations, this force effectively biases the support panels 38, 40 toward each other along their respective fold lines F12, F13, causing the support panels to expand within the shell 112. As the support panels 38, 40 expand, their outer peripheries urge the interior wall 118 of the shell 112 outwardly so as to transition the display unit 110 toward the use position.

Due to the superior material strength of the support panels 38, 40, this engagement causes the shell 112 to radially expand. However, it has been found that the positioning of the display unit 110 in the folded position may tend to create an air vacuum effect between portions of the display unit 110, such as, for example, between the central poster areas A3, A4, and this vacuum effect may inhibit the full expansion of the shell 112. Accordingly, any number of air release holes may be provided in the components of the display unit 110 to reduce or eliminate such a vacuum effect. In one embodiment, air release holes (shown in phantom) may be provided on the central poster areas A3, A4, such as, for example, along the flap fold lines F8, F9 and/or along the longitudinal fold line F1. In addition or alternatively, air release holes may be provided on the upper and lower support panels 38, 40.

In one embodiment, a central support panel 41 may be provided to combat the air vacuum effect or for other reasons, such as, for example, to overcome a tendency of the material of the central poster areas A3, A4 to stick together, or to provide additional structural support to the display unit 110. Like the upper and lower support panels 38, 40, the central support panel 41 may be movable between an expanded position (FIG. 4) and a collapsed position (FIG. 5). The panel tabs 55, 57 of the central support panel 41 may be attached to the interior wall 118 of the shell 112 between the central poster areas A3, A4, such that the central bracket 42 and/or the elastic bands 44, 46 may pass through the clearance hole 63 of the central support panel 41. In this manner, the central support panel 41 may expand and collapse in a way similar to the upper and lower support panels 38, 40, so as to assist with the expansion of the shell 112 without interfering with the operation of the central bracket 42.

When the support panels 38, 40 are expanded, the upper and lower seam tabs 114, 116 provide a positive stop to counter any remaining tension force and to prevent the support panels from becoming inverted along their fold lines F12, F13. If auxiliary tabs 117, 119 are used, the auxiliary tabs may provide an additional positive stop to prevent the support panels 38, 40 from becoming undesirably lopsided. In their expanded positions, the support panels 38, 40 act as a brace to maintain the display unit 110 in a fully expanded "use" position, as shown in FIG. 10. If a central support panel 41 is used, the central support panel may act as an additional brace.

In the embodiment shown, each of the upper, lower, and central support panels 38, 40, 41 are substantially flat when the display unit 110 is in the use position (e.g. when the support panels are expanded). However, it may be desirable for at least one of the support panels 38, 40, 41 to maintain a slight fold along its fold line F12, F13, F14 when the display unit 110 is in the use position (e.g. the support panel may be partially folded about its fold line). For example, the central support panel 41 may maintain a slight fold along its fold line F14 when the display unit 110 is in the use position, so as to prevent the central support panel 41 from becoming inverted along its fold line F14 and to urge the central support panel 41 to collapse in a preferred direction when the display unit 110 is to be returned to the folded position (described below).

When the display unit 110 is in the use position, the first and second front faces 12, 14 each assume convex shapes such that the display unit has a substantially elliptical cross section corresponding to the shape of the support panels 38, 40. In this manner, the support assembly 36 places the shell 112 into its proper configuration, such that the display unit 110 may be considered self-deployable. In other words, the display unit 110 automatically assumes its use position with no manipulation other than being gripped by an upper poster area A1, A2. More specifically, the display unit 110 may be unfolded from the folded position to the intermediate position by gravity, and the display unit may be expanded from the intermediate position to the use position by the tension of the elastic bands 44, 46. Advantageously, the shape of the display unit 110 in the use position allows the display unit to be a free-standing unit, with no need for an additional stand device or other support element. In this manner, the support assembly 36 may independently support the first and second front faces 12, 14 in a vertical position, as may be desired.

In the embodiment shown, the poster areas A1, A3, A5 on the first front face 12 are visible from a first side of the display unit 110, and the poster areas A2, A4, A6 on the second front face 14 are visible from a second side of the display unit, such that visual information may be observable from different sides and multiple directions. The desired visual information may have been placed on the poster areas A1, A2, A3, A4, A5, A6 beforehand, such as, for example, by printing at the same time as or after the forming of the sheet 10. Alternatively, the visual information may be placed on the poster areas A1, A2, A3, A4, A5, A6 subsequent to forming the sheet. For example, the visual information may be printed on poster areas A1, A2, A3, A4, A5, A6. In another embodiment, the visual information may be adhesively applied to the poster areas A1, A2, A3, A4, A5, A6.

When the display unit 110 is to be returned to the folded position for storage or transportation, the user may grip the upper support panel 38 by way of the aperture 60 (FIG. 4) and apply an upward force thereto in order to overcome the tension force and return the upper support panel to its collapsed position. In a similar manner, the user may return the lower support panel 40 to its collapsed position. With both upper and lower support panels 38, 40 in their collapsed positions and no longer acting as a brace, the shell 112 loses its elliptical cross section and moves toward a flattened configuration. If a central support panel 41 is used, the central support panel may also return to its collapsed position as a result of the flattening of the shell 112. The user may then fold the display unit 110 along the lateral fold lines F2, F3, F4, F5 such that the support assembly 36 folds with the faces 12, 14, in order to make the display unit compact again. The folded display unit 110 may then be stored or transported to another location, where it may again be erected into the use position in the manner previously described.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described.

Accordingly, departures may be made from such details without departing from the scope or spirit of the general inventive concept.

What is claimed is:

1. A display unit for providing information to a desired audience, comprising:

an outer shell having one or more areas for displaying information; and an inner support assembly coupled to the outer shell and configured to support the outer shell during use of the display unit, wherein the support assembly comprises upper and lower support panels coupled together by at least one spring member configured to exert a tension force on the upper and lower support panels, the upper and lower support panels each comprising a panel fold line and an elliptical cross section, wherein the display unit has at least one folded position and a use position, the display unit being self-deployable such that the display unit automatically transitions from a folded position to the use position, and wherein each of the panel fold lines extends along a central axis of the respective support panel.

2. The display unit of claim 1, wherein the at least one folded position includes a first folded position, the support assembly being folded within the outer shell in the first folded position such that the upper and lower support panels are collapsed along their respective panel fold lines.

3. The display unit of claim 2, wherein the at least one folded position includes an intermediate position, the at least one spring member exerting a tension force on the upper and lower support panels such that the upper and lower support panels are biased toward each other along their respective panel fold lines in the intermediate position.

4. The display unit of claim 3, wherein the biasing of the upper and lower support panels along their respective panel fold lines causes the upper and lower support panels to expand such that the display unit transitions to the use position.

5. The display unit of claim 1, wherein the upper and lower support panels are each fixedly attached to an interior wall of the outer shell.

6. The display unit of claim 5, wherein the upper support panel is fixedly attached to the interior wall at first and second locations opposite each other relative to the respective panel fold line, and wherein the lower support panel is fixedly attached to the interior wall at third and fourth locations opposite each other relative to the respective panel fold line.

7. The display unit of claim 1, wherein the upper and lower support panels each further comprise a hinge flap, and wherein the at least one spring member is coupled to each hinge flap.

8. The display unit of claim 1, wherein the upper and lower support panels are coupled together by two spring members and a spacer disposed therebetween.

9. The display unit of claim 1, wherein the at least one spring member comprises at least one elastic band.

10. The display unit of claim 1, wherein the support assembly further comprises a central support panel disposed between the upper and lower support panels, wherein the central support panel includes an opening, and wherein the at least one spring member extends through the opening.

11. The display unit of claim 10, wherein the central support panel comprises a fold line.

12. The display unit of claim 11, wherein the central support panel is at least partially folded about the fold line when the display unit is in the use position.

13. The display unit of claim 1, further comprising at least one air release hole positioned on at least one of the outer shell and the inner support assembly.

14. A method of erecting a display unit including an outer shell having lateral fold lines and an inner support assembly for supporting the outer shell, the support assembly including upper and lower support panels coupled together by at least one spring member, the upper and lower support panels each including a panel fold line and an elliptical cross section, the display unit having a folded, an intermediate, and a use position, the method comprising:

gripping a portion of the display unit in the folded position; and releasing the display unit such that the display unit self-deploys from the folded position to the use position, wherein the upper and lower support panels at least partially unfold about the respective panel fold lines, and wherein each of the panel fold lines extends along a central axis of the respective support panel.

15. The method of claim 14, wherein releasing the display unit such that the display unit self-deploys from the folded position to the use position further comprises transitioning the display unit from the folded position to the intermediate position by allowing the remaining portions of the display unit to unfold about the lateral fold lines under the influence of gravity.

16. The method of claim 15, wherein releasing the display unit such that the display unit self-deploys from the folded position to the use position further comprises transitioning the display unit from the intermediate position to the use position using a force generated by the display unit itself.

17. The method of claim 16, wherein transitioning the display unit from the intermediate position to the use position further comprises expanding the inner support assembly using a force generated by the display unit itself.

18. The method of claim 17, wherein the at least one spring member exerts a tension force on the upper and lower support panels in the intermediate position to generate the force for transitioning the display unit to the use position.

* * * * *